US007182283B1

(12) United States Patent
Santucci

(10) Patent No.: US 7,182,283 B1
(45) Date of Patent: Feb. 27, 2007

(54) PULVERIZER REAL-TIME MONITORING SYSTEM

(75) Inventor: Michael T. Santucci, Akron, OH (US)

(73) Assignee: Engineering Consultants Group, Inc., Akron, OH (US)

( * ) Notice: Subject to any disclaimer, the term of this patent is extended or adjusted under 35 U.S.C. 154(b) by 60 days.

(21) Appl. No.: 11/016,244

(22) Filed: Dec. 17, 2004

(51) Int. Cl.
*B02C 4/32* (2006.01)

(52) U.S. Cl. ..... 241/37; 241/101.3; 241/117

(58) Field of Classification Search ..... 241/33, 241/37, 117, 119, 121, 101.3; 73/821, 823
See application file for complete search history.

(56) References Cited

U.S. PATENT DOCUMENTS

| | | | | |
|---|---|---|---|---|
| 3,591,094 | A * | 7/1971 | Gauer | 241/37 |
| 4,562,044 | A | 12/1985 | Bohl | 422/64 |
| 5,048,761 | A | 9/1991 | Kim | 241/19 |
| 5,763,786 | A | 6/1998 | Camplin et al. | 73/643 |
| 2004/0115791 | A1* | 6/2004 | Sim et al. | 435/254.1 |
| 2005/0263630 | A1* | 12/2005 | Zhang et al. | 241/100 |

OTHER PUBLICATIONS

"On-Line Vibration Monitoring System for MPS-Type Mills" Electric Power Research Institute, Inc.; Project Opportunity brochure Aug. 2003.

Dynamic Analysis Pinpoints Pulverizer Problems, Power Engineering, Oct. 1998.

Pulverizer Grinding Elements Analyzer , Engineering Consultants Group, Inc., 1999.

Pulverizer Grinding Elements Analyzer, Engineering Consultants Group, Inc., Mar. 23, 1998.

* cited by examiner

*Primary Examiner*—Faye Francis
(74) *Attorney, Agent, or Firm*—Renner Kenner Greive Bobak Taylor & Weber

(57) ABSTRACT

A pulverizer monitoring system is applicable to at least one pulverizer having a rotatable bowl assembly, and at least one journal assembly having a grinding roll positioned proximal the rotatable bowl assembly, wherein the grinding roll is deflected by the feedstock raw material forced under the roll during rotation of the rotatable bowl assembly. A position sensor is mounted to the journal assembly to detect an amount of deflection of the grinding roll and generates a position signal, wherein a data module is associated with each pulverizer so as to receive the position signal. A calculation engine is linked to each data module for the purpose of analyzing the position signal and other operational signals associated with the pulverizer and generating at least one characteristic pulverizer condition report. A web-based server is linked to the calculation engine to provide network access to the characteristic report(s), either real-time or historical trends. A user interface is provided with either the calculation engine and the web-based server to allow the custom setting of alarms and/or formats for the output associated with the characteristic report(s).

12 Claims, 13 Drawing Sheets

| Current Alarms For Unit 19 – Mill A | | | | |
|---|---|---|---|---|
| Detection | Mill | Roll 1 | Roll 2 | Roll 3 |
| High Bowl Amplitude | 3 | | | |
| High Resultant Force | | | | |
| High JHS Gap | | | | |
| Low Mean Deflection | | | | |
| High Roll Amplitude | | 6 | | |
| Step Change in Deflection | | | | |
| Journal Head Touching Stop | | 3 | | |
| Low Standard Deviation | | | | |
| High Deflection | | | | |
| Roll Separation | | | 11 | 1 |
| Roll Hitting | | | | |
| Bad Autozero | | | | |
| High Roll Speed | | | 2 | 1 |
| High User 1 Amplitude | | | | |
| High User 2 Amplitude | | | | |
| High User 3 Amplitude | | 1 | 1 | |

FIG–12

PULVERIZER REAL-TIME MONITORING SYSTEM

TECHNICAL FIELD

The present invention is generally related to pulverizers. More specifically, the present invention is related to monitoring equipment associated with a pulverizer. In particular, the present invention is related to a real-time monitoring system which generates various reports indicating the operational health of a pulverizer and/or a group of pulverizers and which also provides the ability to set alarm indications whenever a pulverizer is operating outside of predetermined criteria.

BACKGROUND ART

Many industrial processes require the grinding of materials to fine particles either as raw materials or as an intermediate or final product. The materials to be ground might include coal, stone, metal ores, crystalline chemicals, etc. The grinding or pulverizing equipment is usually exposed to severe conditions both due to the nature of the materials and the restraints of the environment. These equipment considerations are likely to include the following: abrasive raw materials; high energy input requirement; toxicity (leak proof containment); vibration; explosive or combustible characteristics; large volume/mass rates with low profit margin processes; and around the clock/long term operations.

These conditions often mandate the construction of the equipment such that thick-walled, abrasion resistant, high strength materials are required to confine the process materials within a grinding zone thus limiting access to the internal components that are most susceptible to aggressive wear, damage and/or degradation. With many of these processes being quasi-continuous, any down time that interrupts the process is very costly and a major consideration in the economic viability of the plant utilizing the equipment. But the condition of the grinding zone components must be known to assure equipment performance and process reliability of the production runs yet indicate timely, component specific maintenance requirements with the minimum of unavailability.

Many of the maintenance practices and timing intervals on such pulverizing equipment have been derived from historical experience with scheduled overhauls based either on accumulated throughput of the raw material/product or on the run time. This history-based practice can have significant error with avoidable costs from the premature expenditure of manpower and replacement of expensive parts that have remaining life. Worse yet, the reactive maintenance could be after-the-fact with premature failure having been due to accelerated wear or other unanticipated damage. This latter situation normally incurs major production shortfalls with unacceptable maintenance costs and delays in return to service due to the short-term parts acquisition and/or the unscheduled manpower requirements (i.e., overtime or contractor augmented work force).

It is also known to put monitoring equipment on various components of the pulverizer and to collect data there from on a periodic basis. After a number of data collection events, it is then possible to determine potential areas for maintenance. However, prior art data collection devices have not been able to format the data in a direct and user-friendly format. Moreover, testing in this manner was done on a piecemeal basis and a real-time analysis of the operation of the pulverizing equipment was not available. Moreover, no known systems allow for system-wide monitoring of pulverizer units utilized in production settings or other industrial applications. Accordingly, there is a need for such a monitoring system that allows for real-time analysis of pulverizer units singly and/or collectively.

SUMMARY OF THE INVENTION

Therefore, it is a first aspect of the present invention to provide a pulverizer real-time monitoring system.

It is yet another aspect of the present invention to provide a pulverizer monitoring system comprising at least one pulverizer including a rotatable bowl assembly, at least one journal assembly having a deflectable grinding roll positioned proximal each rotatable bowl assembly, and a position sensor mounted to at least one journal assembly to detect an amount of deflection of the grinding roll, the position sensor generating a position signal; a data module associated with each pulverizer, the data module receiving each position signal; a calculation engine linked to each data module, the calculation engine analyzing the position signal and generating at least one characteristic report; and a work station linked to the calculation engine to allow access to at least one characteristic report.

BRIEF DESCRIPTION OF THE DRAWINGS

For a complete understanding of the objects, techniques and structure of the invention, reference should be made to the following detailed description and accompanying drawings, wherein:

FIG. 12 is an exemplary user interface screen to allow for setting of ranges in association with an alarm notice provision of the system.

BEST MODE FOR CARRYING OUT THE INVENTION

Figure 1:
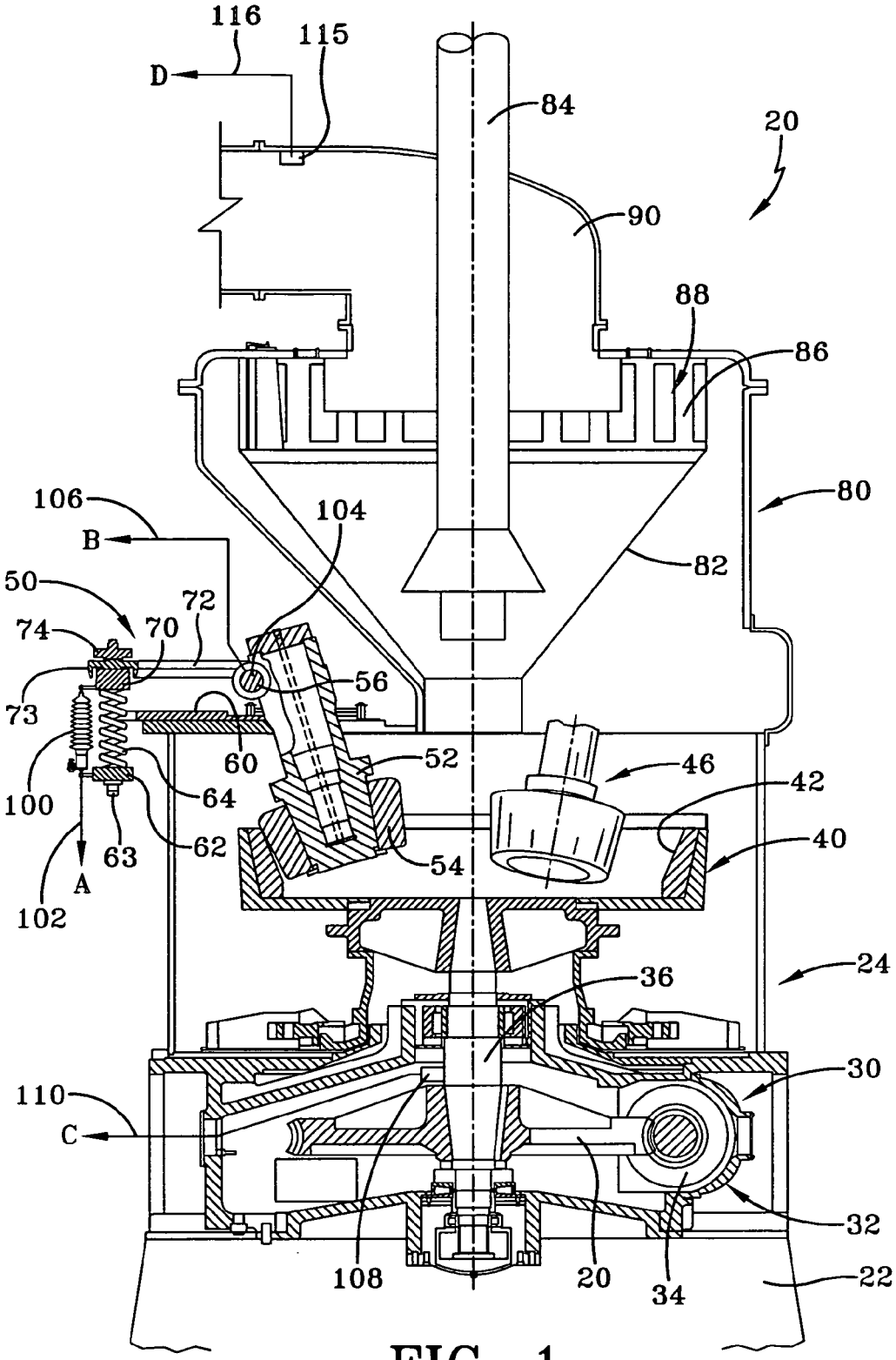
FIG. 1 is a partial cross-sectional view of an exemplary pulverizer with associated monitoring devices according to the present invention.

Referring now to the drawings, and in particular to FIG. 1, it can be seen that a pulverizer according to the present invention is designated generally by the numeral 20. The pulverizer 20 is an exemplary unit and it will be appreciated that the teachings herein are applicable to any grinding device which utilizes at least one grinding roll associated with a motor-driven bowl. In other words, expected variations in the structure of the exemplary pulverizer are inconsequential to the teachings of the invention. In any event, as such a pulverizer may be used to grind raw materials into finer or smaller particulate matter. Exemplary raw materials are coal, stone, metal ores, crystalline chemicals and the like. As used herein, the pulverizer is primarily associated with coal pulverizers utilized in conjunction with boiler systems and the like.

The pulverizer 20 is mounted upon and supported by a foundation 22. The pulverizer includes a mill housing 24 that is secured to the foundation and which supports and contains other structural components of the pulverizer. Contained within the mill housing 24 is a drive assembly 30. Generally, the drive assembly includes a motor-driven worm drive assembly 32, which in turn rotates a worm gear 34 that engages and rotates a mill shaft 36. Alternatively, the mill shaft might be driven by reduction gears. Coupled to the mill shaft 36 is a grinding bowl 40 that includes replaceable wear components 42 that wear over a period of time and which can be rebuilt or replaced during periodic servicing.

At least one roll assembly, designated generally by the numeral 46, is placed in close proximity to the revolving bowl. In most embodiments, three roll assemblies are equidistantly disposed about the bowl and are supported by the mill housing 24. In particular, each roll assembly 46 is a part of a journal assembly 50 supported by the mill housing 24. The journal assembly 50 includes a roll assembly 52, which rotatably supports at one end a grinding roll 54. The journal assembly 50 is mounted to the mill housing in such as way as to place the rotatable grinding roll 54 in close proximity to wear components of the grinding bowl 40. The roll assembly 52 is mounted upon and rotates about a roll pivot shaft 56, which allows the roll assembly 52 to deflect slightly during operation. In other words, the roll assembly deflects a certain amount from the bowl depending upon the preload, the type and feedrate of the material being pulverized and other factors.

A support arm 60 extends from the mill housing and typically there are two support arms associated with each journal assembly 50. Further extending from the support arm 60 via a preload adjustment threaded rod 63 is a spring base 62, which carries a spring 64. Typically two springs 64 are employed side-by-side. Each spring 64 has a bottom end in contact with the spring base 62. A journal arm 72 extends from the roll assembly 52 to engage a spring cap 70. As a rigid part of the roll assembly, the journal arm 72 deflects with the roll assembly. The springs 64 have their lower end restrained through the threaded rods 63 and the spring base 62. With an empty mill or at zero deflection, the journal arm 72 is held on the upper side by a stop bar 74 and on the lower side by the preloaded springs 64 through the spring cap 70. In operation, the roll assembly 52 is deflected when the grinding forces against the roll 54, which are transferred through the journal arm 72, are sufficient to overcome the preloaded spring force. Further deflection of the roll assembly will thus be the equilibrium point when the compressive spring force is equal to the grinding forces as transmitted through the journal arm 72.

A separator housing 80 is disposed around the journal assemblies 50 and is supported by the mill housing 24. Contained within the separator housing 80 of this exemplary pulverizer is a center feed inlet 84, which extends into a separator cone 82, wherein the inlet 84 deposits the raw material into the center of the grinding bowl 40. The raw material is then uniformly distributed radially by centrifugal force to the grinding zone of the bowl whereupon the material is crushed by the grinding rolls 54. While the material is repeatedly crushed and ground to a finer consistency, conveyance gas, usually air, is forced into the mill housing and the finer particles are carried upwardly into the separator housing 80 where the gas and particles are given a tangential velocity by a plurality of guide vanes 86 that extend from the top closure of the housing 80. Those particles that are fine enough to follow the gas streamlines within the separator cone 82 are then conveyed through the outlet pipe 90. Those larger particles that are separated by centrifugal force are returned via the separator cone 82 for further grinding by the revolving bowl 40.

A plurality of sensors are associated with the pulverizer 20 to monitor operating characteristics thereof. A linear position sensor 100 is connected between the spring base 62 and the journal arm 72 so as to determine the proportional deflection for each roll assembly 46. An exemplary linear position sensor is the TEMPOSONICS® L-series with analog output. The sensor 100 generates a position signal 102 which may also be designated by the capital letter A. Another type of sensor may be an angle sensor 104, which measures the angular displacement of the journal assembly 50 and in particular is associated with the roll pivot shaft 56. The angle sensor 104 generates an angle signal 106, which is represented by the capital letter B. Yet another sensor is a vibration sensor 108 that is coupled to the mill shaft 36 or a component directly associated therewith. The sensor 108 generates a vibration signal which is represented by the capital letter C. A coal fineness sensor 115 generates an output performance signal 116 designated by the capital letter D. Of course, other sensors may be associated with components that move within the pulverizer and their corresponding output signals are generated. And other input/output signals may be imported into or collected by the calculation engine 128, the server 132 and/or the workstation 136 shown in FIG. 2.

Figure 2:
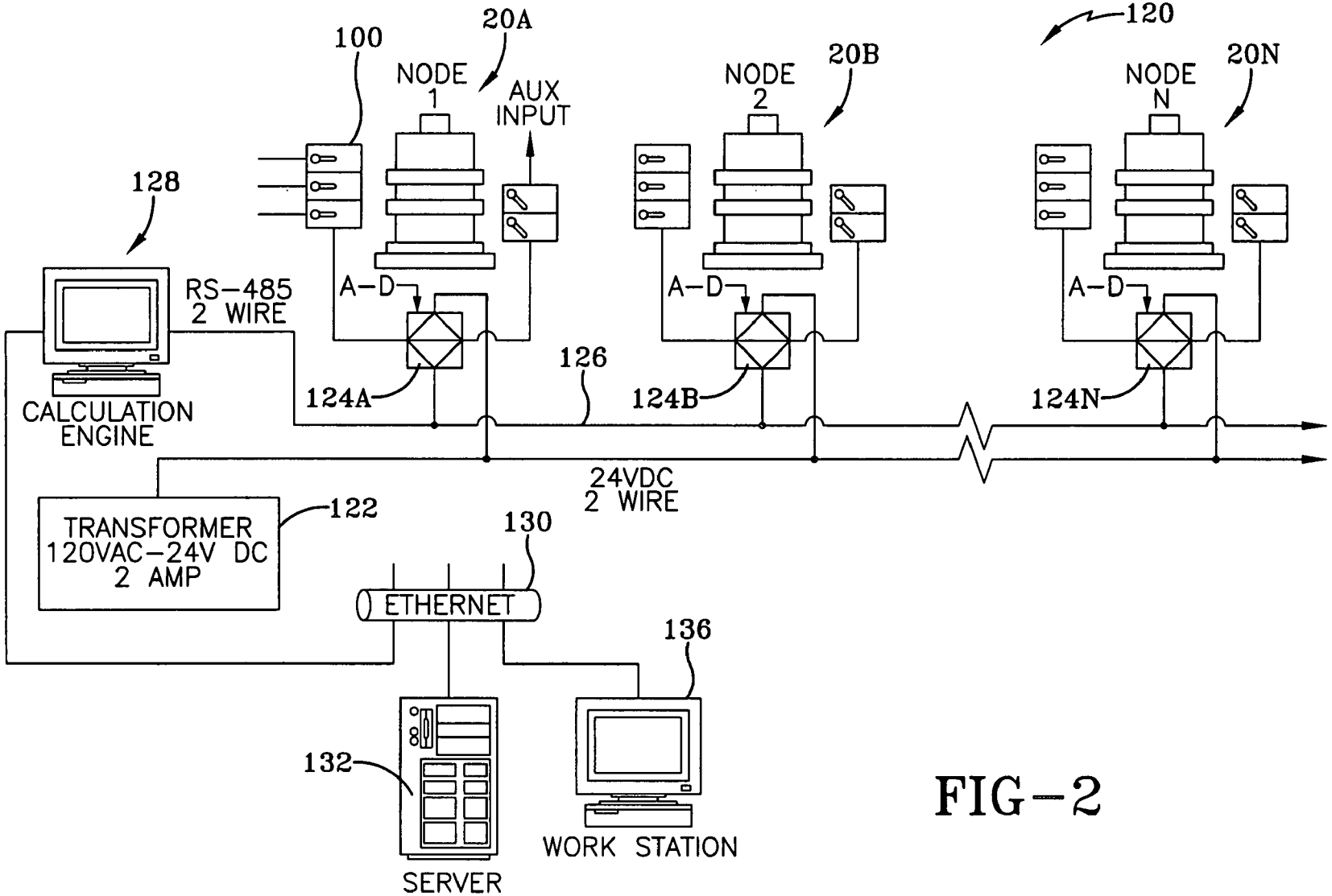
FIG. 2 is a schematic diagram of a monitoring system made in accordance with the concepts of the present invention.

Referring now to FIG. 2, it can be seen that a pulverizer real-time monitoring system made in accordance with the concepts of the present invention is designated generally by the numeral 120. The system 120 may monitor a single pulverizer 20A or multiple pulverizers designated as 20B through 20N, where N represents any number. Input power 122 is provided to an input/output module 124 which may also be referred to as a data acquisition unit. The power supply to each module may be transformed from 120 volt AC to 24 volt DC at 2 amps or whatever value is required. Each module 124 is connected to the various sensors and in particular to sensor 100 which monitors each of the journal assemblies 50 and any other auxiliary sensor such as 104, 108 and 115. The respective signals A, B et cetera generated by these sensors are input to the module 124 and are then transmitted by a two-wire bus 126 in an appropriate format to a calculation engine 128.

The calculation engine 128 is a computer-based multitasking device, which contains the necessary hardware, software and memory for processing the signals received by each of the modules 124. The calculation engine 128 is an on-site computer that requires capability for the computational performance demands. It will further be appreciated that the calculation engine 128 may contain user workstation capabilities, such as a display and keyboard, also referred to as an interface, to allow for direct monitoring of specific pulverizers and their outputs as needed by facility personnel. And the calculation engine 128 may maintain data base features and communicate with a "historian" for the collection of data from the various sensors and other operational data generated by the pulverizer. The historian may take the form of a PI® or SQL® database with associated manipulation and format programs.

The calculation engine 128 is connected via an Ethernet® or other network-type connection—wired or wireless—for communication with a server 132. In this manner, multiple computer workstations 136 may be linked to the server 132 to allow for analysis and review of multiple sites. It will be appreciated that the work station 136 may be an on or off site computer and contains web access capabilities that allows user input for directly monitoring any one of the nodes or pulverizers linked to the calculation engine 128. The work station 136 contains the necessary hardware, software and memory for viewing an on-line website hosted by the server 128.

With the configuration described above, it will be appreciated that the system 120 is able to detect adverse stress conditions, provide timely alarms and indicate specific maintenance procedures for the purpose of avoiding or correcting root causes of problems associated with the respective pulverizers. Based upon the monitoring techniques and processes used in analyzing the operational signals, various problems with the pulverizers have come to light in relation to their operation. For example, uneven distribution of work input by the grinding rolls within a specific pulverizer or mill can have a significant effect on the stress distribution and, in the case of rotating shafts, the tensile and compression cyclic stresses that lead to accumulated damage of the components with eventual fatigue life implications such as localized wear and/or breakage.

Figure 3:
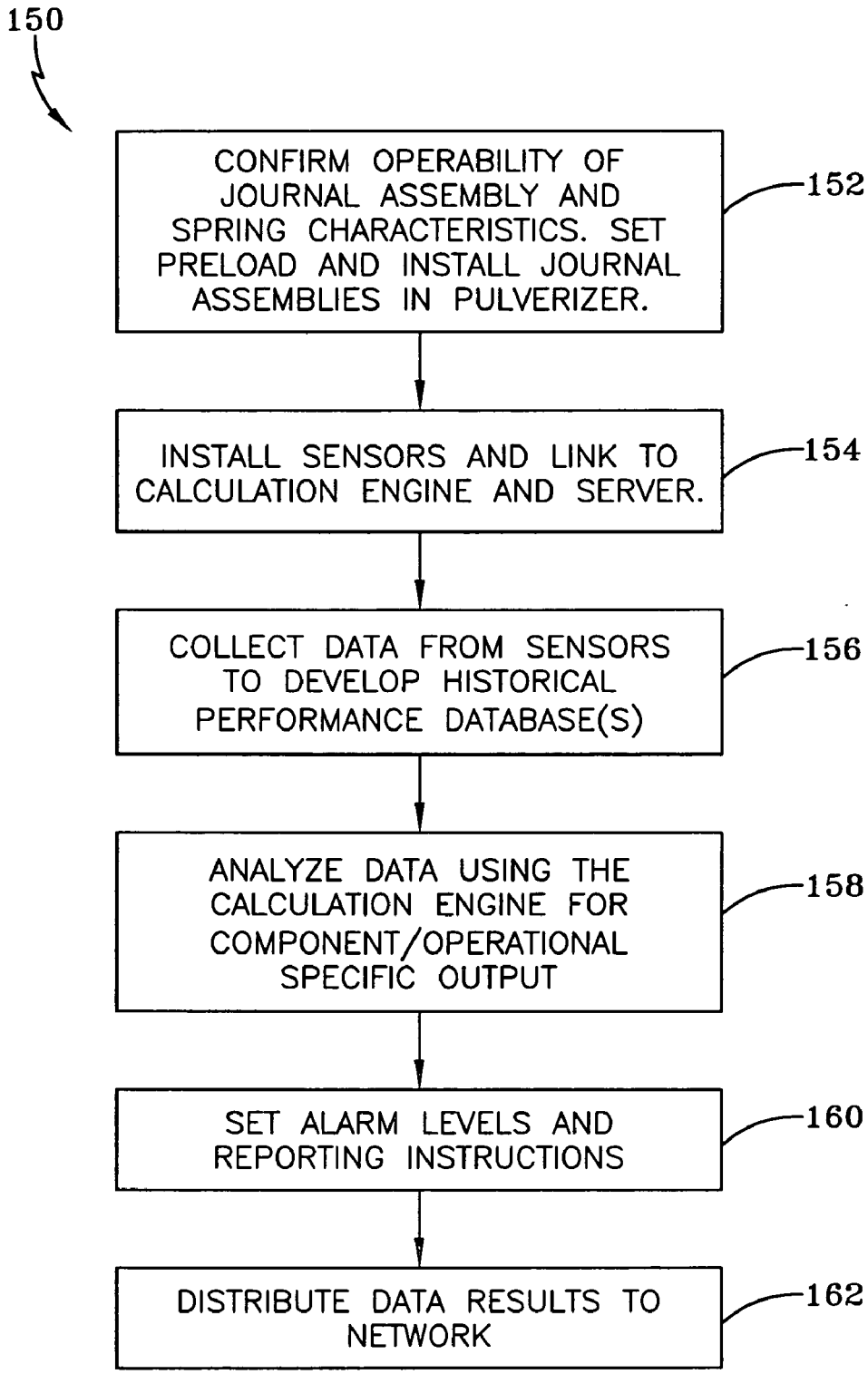
FIG. 3 is a flowchart illustrating the operational steps for implementing the monitoring system.

Referring now to FIG. 3, an implementation procedure for each of the exemplary pulverizers and their respective nodes in the overall system is designated generally by the numeral 150. At a first step 152, each operational journal assembly is checked for spring calibration within specifications and the preload must be accurately adjusted to establish optimal settings. This spring or multi-spring preload might be done on a bench test bed or done in-situ with an appropriate testing rig. The journal is then set to the pulverizer manufacturer's guideline for alignment to the bowl profile and for proper clearances. With these aforementioned parameters assured and the journal in good condition, the pulverizer operational signature traits using the subject invention, as customized for the applicable pulverizer, is expected to be within all acceptable criteria. Next, at step 154, qualified technical personnel installs the displacement and other sensors to collect the appropriate operational data and connect the sensors to the calculation engine and/or the server 132 and the workstation. Next, at step 156, normal operations of the pulverizers are started and the selected sensor data is collected to develop historical database information. Step 156 includes the step of the calculation engine 128 determining the defined state of the pulverizer, either off, autozero, start-up, steady load, or shutdown, from the sensor and control device(s) associated with the drive assembly or other control devices associated with the pulverizer. Preprogrammed data sampling instructions from the system software are then acquired based upon the state of the pulverizer. The data collection process continues with the server sending sampling directives and initiating data acquisition by the module 124 from the sensors. The data is then collected and processed by the calculation engine/server with the results stored in the plant historian maintained by the server 132 and/or the calculation engine 128. Next, at step 158, the various processes associated with the calculation engine/web server 128 format the data into meaningful output as provided in the algorithms' capabilities incorporated in the software. At step 160, the preset alarm levels and acceptable ranges of operation, and also reporting formats and instructions are referenced whenever any of the alarm levels are exceeded. And, at step 162, the results of any desired data, either real-time or historical, can be issued via the web server to all web accessed workstations and are viewable on the network for loading the observed data into databases and for analysis by various personnel, either on-site or off-site via the server, such as on a web-based format.

With this system configuration, it will be appreciated that the uneven distribution of the forces applied by the grinding rolls among the grinding elements can be detected. Measurement of each element's initial loading, usually with a precision-applied preload of the calibrated spring 64, establishes a force baseline for each grinding roll. Data collected from the sensors and processed by subroutines maintained in the calculation engine further track the grinding element displacement and determines the individual roll forces as well as the resultant in case of multiple rolls.

After the journal installation and adjustment step, the next development stage, as embodied in step 154, enables measurement of the deflection of the grinding element assemblies with other operational characteristics under real-time dynamic loads. As such, mean deflection is discernable by the signal-processing programs contained in the calculation engine and/or server so as to determine relationships with the material flow conditions, that is the material received through the inlet, during a steady load. Based upon the known preload settings, the pre-determined spring constant properties and the deflection results; the work/mean force contribution of each grinding element can be determined. Accordingly, appropriate adjustments to the equipment can then be made to balance the loads equitably among the grinding elements so that forces are equally applied about the revolving grinding bowl and in turn are balanced about the shaft.

The grinding element displacement is determined by the basic equipment design and variables including wear, preload, the mass flow rate (in-process inventory) and material grindability properties. Collection of the data in a structured and global format-allows for the apparent random motion, which is largely generated by the size distribution and related properties of the feed stock and partially ground materials to be further analyzed. This is done by utilizing a Fourier analysis procedure on a time versus displacement signal so that frequency attributes of the multiple moving components can be discriminated. These frequency indications of the grinding assembly and the individual component's material properties and defects can be derived as the historical records with accumulated signatures, which upon analyzing, can be correlated with verified component inspections. Accordingly, with the extended database development, signature attributes of acceptability can be differentiated from those that would be suspect or deemed appropriate for corrective action.

In the course of collecting operational data for the pulverizers, it has been determined that real-time advice can be generated by comparing the processed sensor data with the algorithms and criteria derived from the historical models. This can be done automatically and made available virtually instantaneously through the use of appropriate software maintained in the calculation engine/web server and the web accessed workstations linked to the network.

Through the server 128, a comparison of signal parameters to acceptability criteria for each attribute can be initiated. If triggered, the alarm/action levels established for prompt, timely advice can then be made available to the process operator, supervisory personnel or others with a need-to-know. This allows for adjustment to the grinding process or otherwise taking appropriate action to bring the process back into specification. It will be appreciated that by doing so, severe damage is avoided to the grinding equipment. These action conditions or other parametric event criteria of a less urgent nature can be sent to the engineering/technical specialists for further analysis and evaluation. Thus, it will be appreciated that the system 120 is a real-time monitor of the pulverizer dynamic signature and an invaluable resource indicating the pulverizer's mechanical condition. The system 120 allows for sequential collection of data from each mill and for reporting both time domain and frequency information collected from each mill roll. The system can then analyze this data and look for problem characteristic signatures of the type of specific grinding mill that might include any of the following off-specification conditions associated with: grinding elements (rolling type skidding); broken springs; mill pluggage; feed stock interruption; journal head-to-spring gap; minimum stop adjustment; broken spring bolts (preload restraint); tramp material-hard (iron, rock, etc.); tramp material-pliable (rubber, rags, plastic, belting, etc.); load temperature (excessive moisture, pre-heater problems, etc.); mill overload; high mill temperature (fire, preheated materials, etc.); preload relaxation (mechanical or hydraulic); excessive mill rejects; high preload (mechanical or hydraulic); grinding element-to-grinding element contact; cracked/bent shaft; shaft to bowl/grinding element fit; bearing/journal problem (identifiable bearing for targeted corrective action); drive train problem; grinding element eccentricity; grinding element deflection low/high; grinding element wear/surface damage; feed stock variation (property changes, excess moisture, contamination, etc.); nonsymmetrical loading; frequency concerns (critical/resident frequency, frequency shift, harmonics, etc.); spring constant changes (overheating, strain beyond elastic limit, etc.); pivot or sliding motion inhibited; lubrication problem indications; motor problems; and fan problems. It will be appreciated that all of the forgoing off-specification conditions will generate a unique signature that is included within the data collected from the various sensors and processed by the calculation engine prior to data storage.

Based upon the historical models developed, unusual signatures or data that appear with a singular component or one pulverizer can be trended for indications of degradation and appropriate corrective action. This allows for investigation during periods of opportunity so as to determine the problem source and severity and may be cataloged and used for further historical data for maintenance of the pulverizers.

Figure 4:
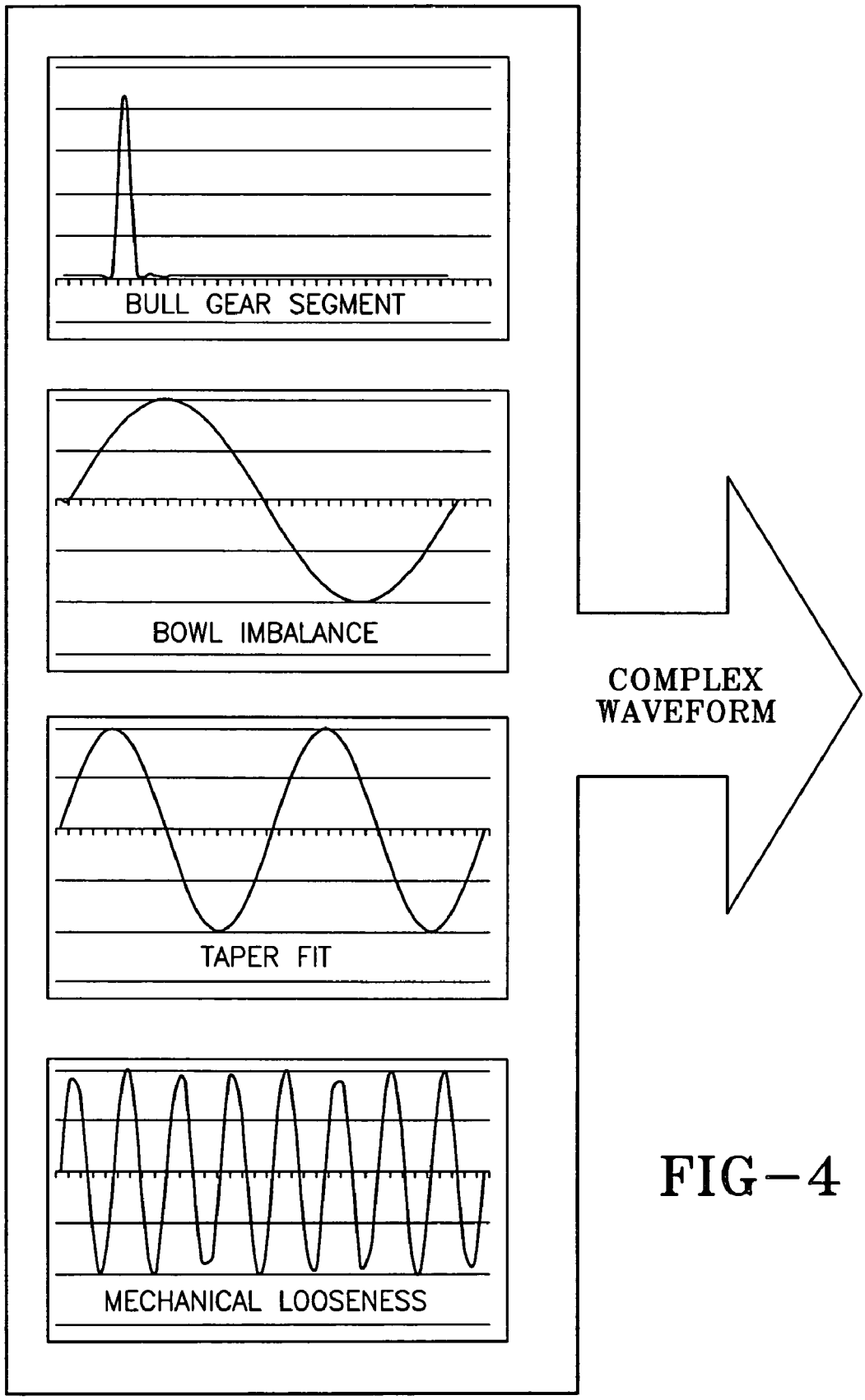
FIG. 4 are graphical representations of time domain waveforms converted into discrete frequencies and amplitudes utilizing fast Fourier transform.

Examples of the various types of data formats that may be obtained utilizing the calculation engine and the workstation are shown in FIGS. 4–11. As shown in FIG. 4, Fourier transforms may be utilized to convert time domain waveform information into discrete frequencies and amplitudes. It will be appreciated that waveforms for each roll bowl or grinding bowl segment; bowl gear segment; bowl imbalance; taper fit or mechanical looseness of various components within the pulverizer; and their frequencies are identifiable through the appropriate use of the Fourier transform. Frequency of the moving components, such as a range of frequency spectrum displays are available depending on the limits of the sampling rate, the sample duration and the displacement or vibration sensor's response capability. Data can be further manipulated in X–Y plots with the coordinates adjusted as required. For example, motor current vs. load, deflection vs. load, grinding element diameter vs. accumulated through put and so on can be evaluated. Displacement data can be collected at start-up introduction of feed stock to an empty mill, which is generally used as a baseline "zero" for deflection reference, to allow for determination of the relative displacement behavior or deflection of the grinding elements. Likewise, a similar procedure can be used during shutdown so as to determine the behavior of the grinding element's deflection during reduction/stoppage of feedstock and the gradual settlement to the minimum stops with an empty mill.

Figure 5:
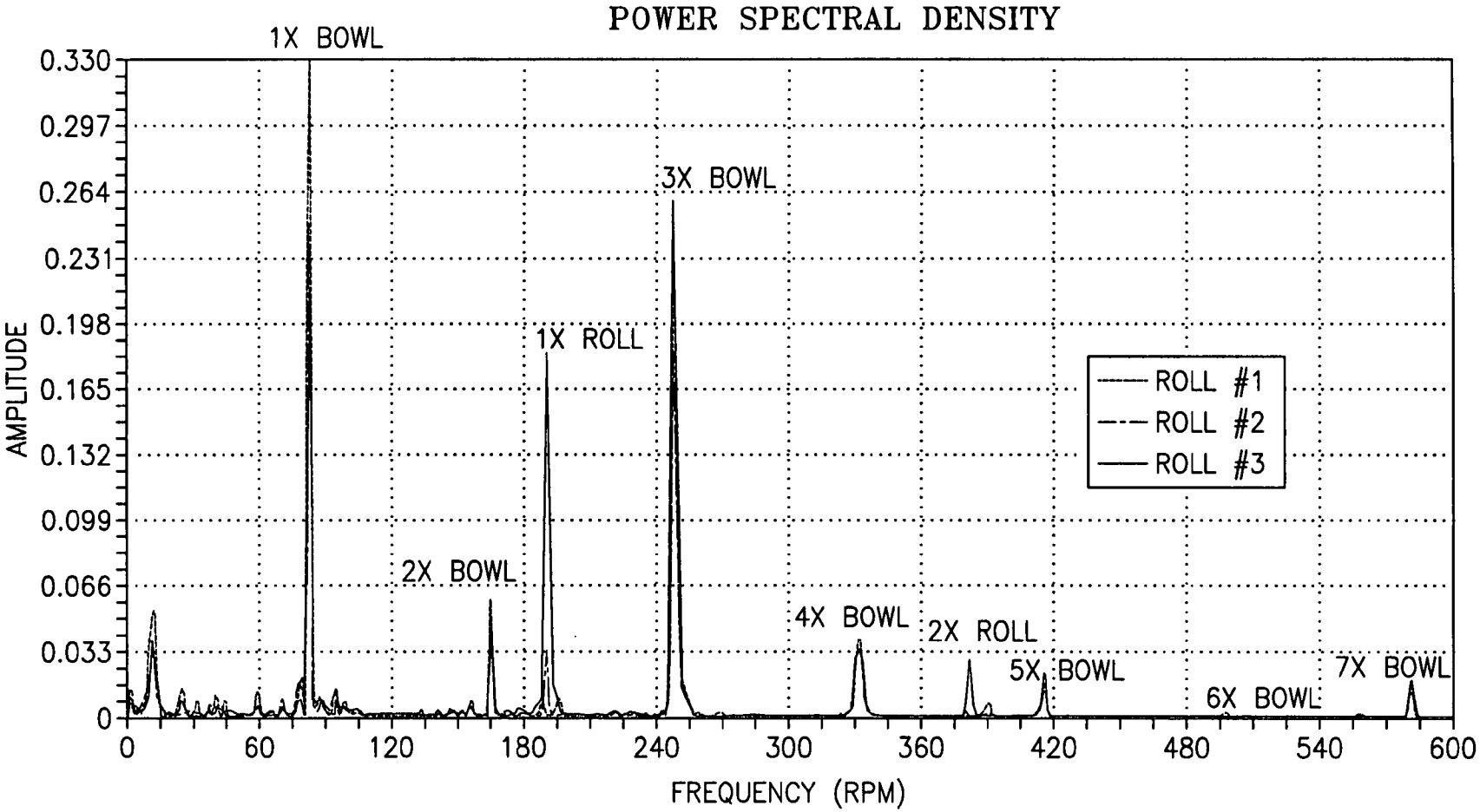
FIG. 5 is frequency domain plot comparing grinding roll characteristics of a single roll to revolving bowl characteristics.
Figure 6:
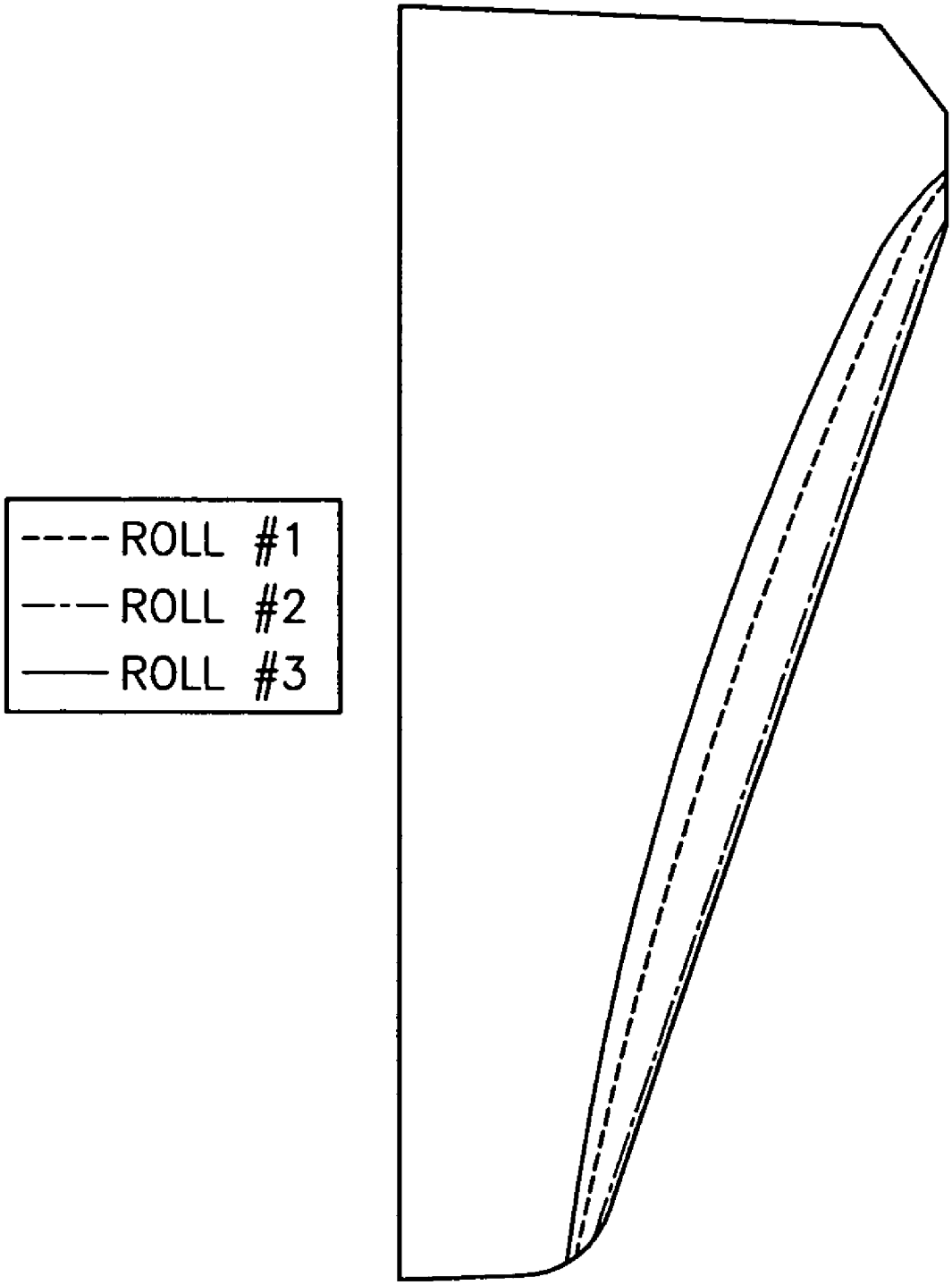
FIG. 6 is a schematic representation of grinding roll wear.
Figure 7:
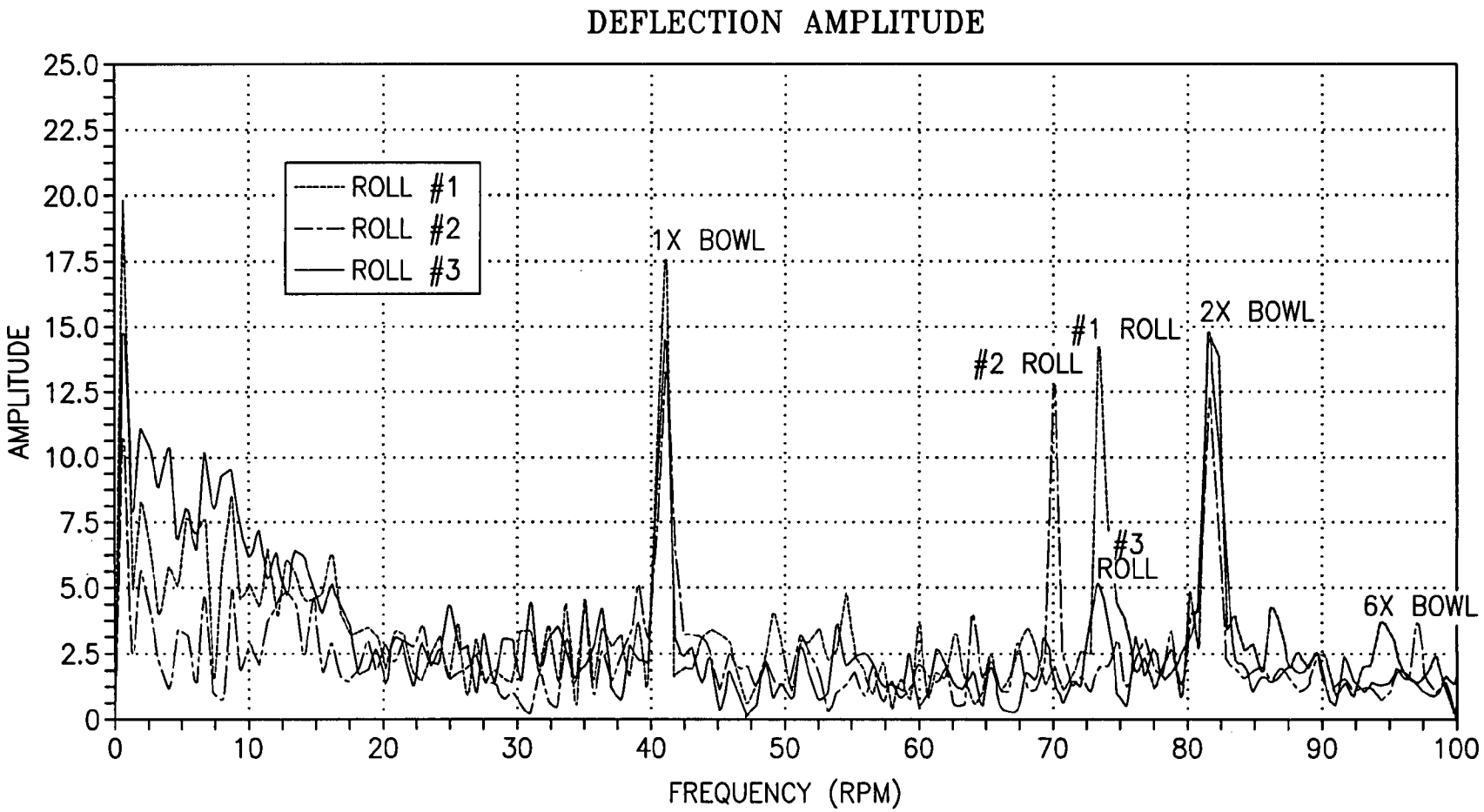
FIG. 7 are frequency domain plots comparing a plurality of grinding rolls characteristics of the revolving bowl in which they are received.

Frequency domain plots allow for detection of periodic "signatures" such as in the bowl and roll; the ability to determine amplitude of component displacement; the ability to find harmonic relationships; the ability to separate effects of close frequency; the ability to analyze roll speed to estimate roll size; the ability to determine the relative health of the mill and the ability to analyze frequency shifts of components, that is, skidding or excessive wear. Accordingly, as seen in FIG. 5, frequency domain plots allow for an analysis of roll speeds with respect to the bowl rotation. Likewise, as shown in FIG. 6, various roll speeds can be compared to indicate relative wear conditions of the respective rolls. This allows for the roll surface grinding elements to be estimated as exemplified in FIG. 7 so as to determine their wear.

Figure 8:
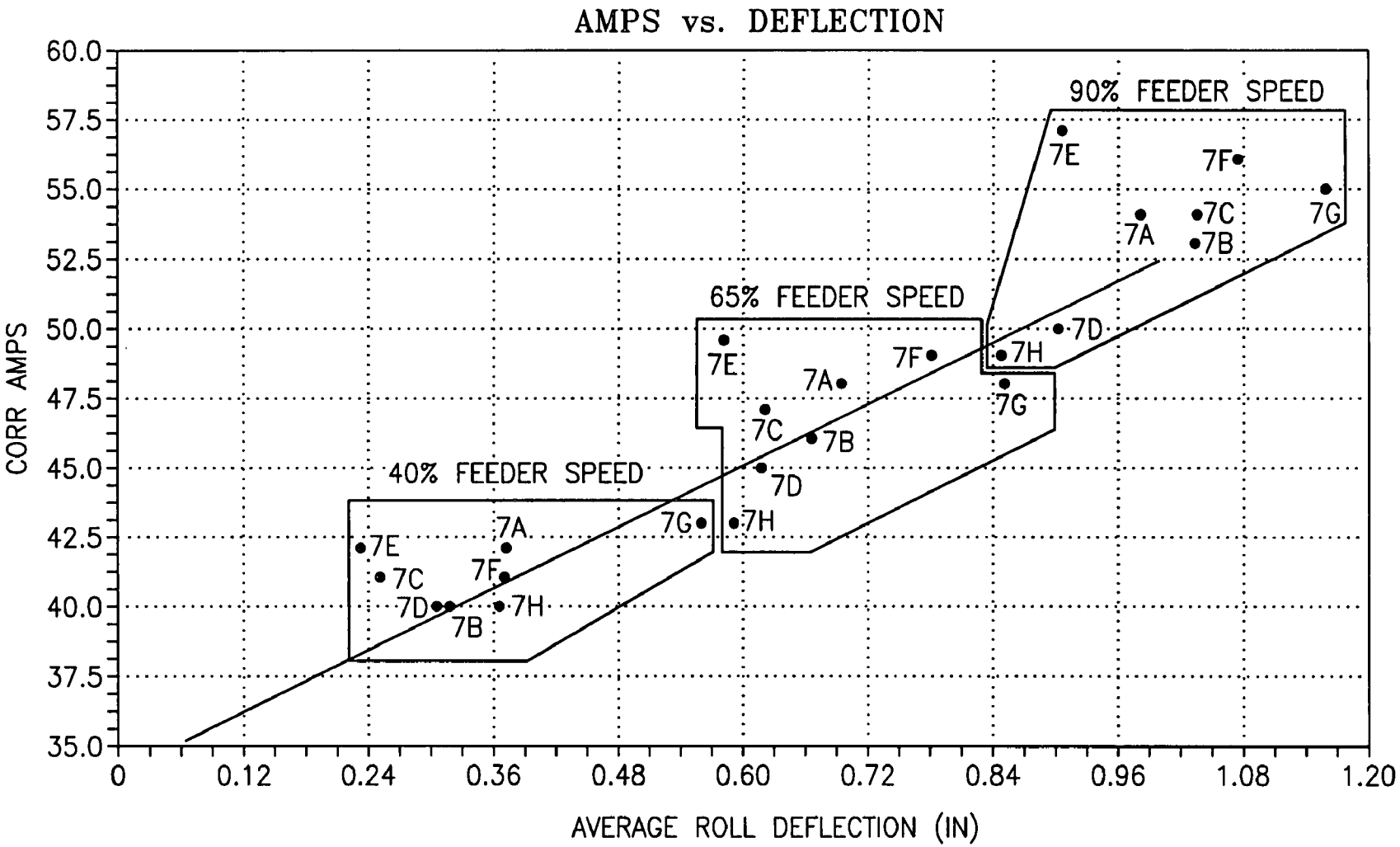
FIG. 8 is a graphical representation of amps vs. deflection representation of a group of pulverizers.

In FIG. 8, an amps vs. deflection database can be utilized to determine the effects of increased input feed rates for a mill-to-mill comparison indicating variation in preloads and/or spring constants as well as mill classifier recirculation variables. The amps value in the database is obtained from the normal operating characteristics of the pulverizer that are input to the calculation engine 128.

Figure 9A:
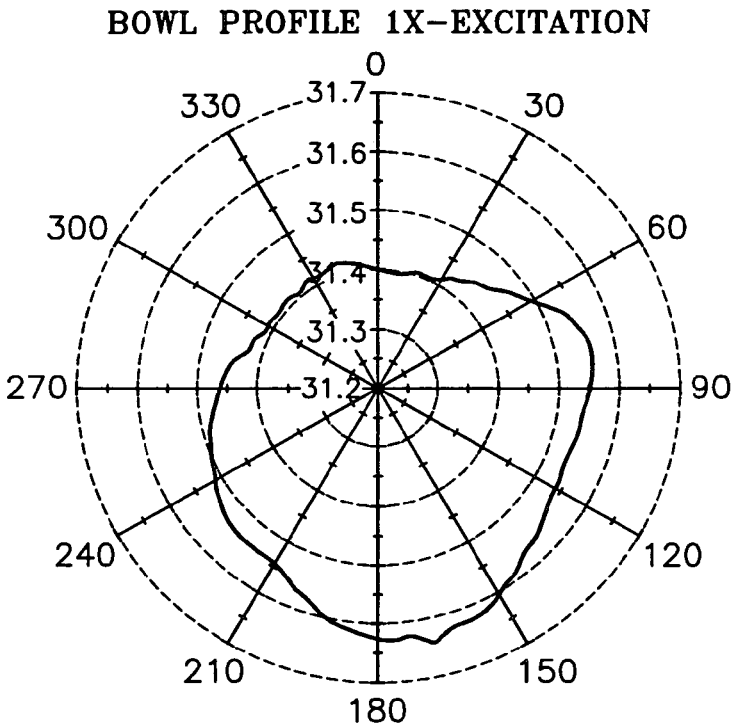
FIGS. 9A–C are graphical representations of grinding element profile plots for the grinding rolls.
Figure 9B:
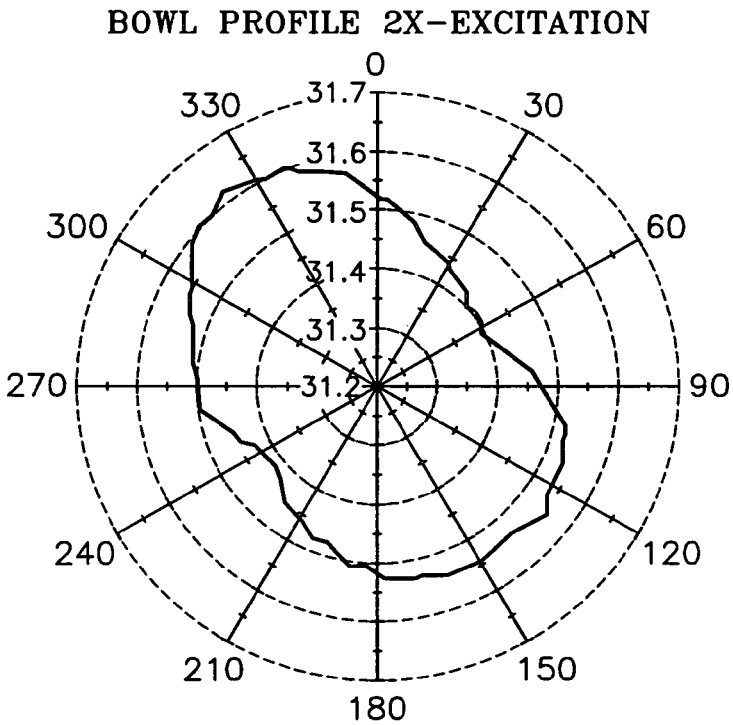
Figure 9C:
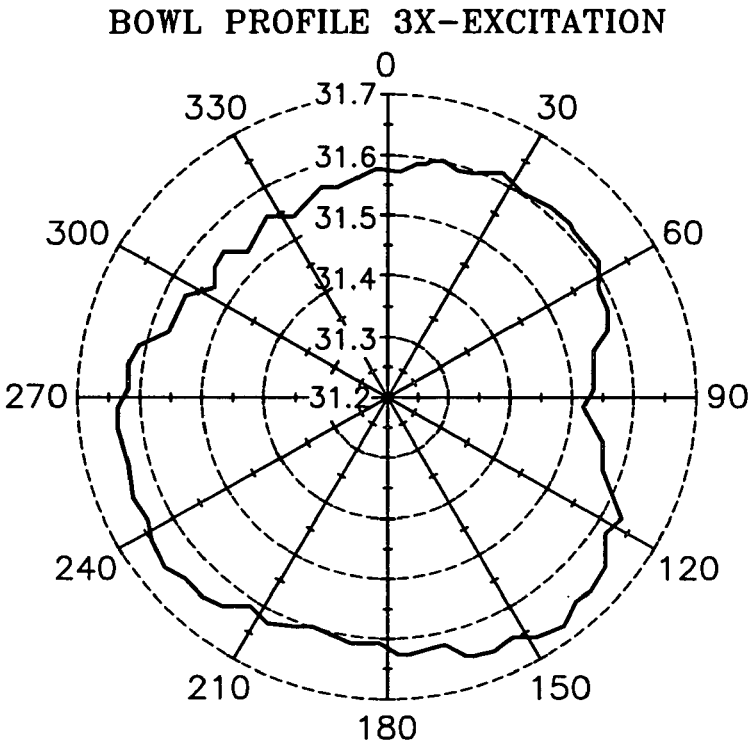

FIGS. 9A–C show grinding bowl profiles that are polar plot representations of the data shown at the various component excitation levels in the frequency spectrum graphics. These polar plots depict typical or average motion of components or drive profiles of the rotating grinding elements.

Figure 10:
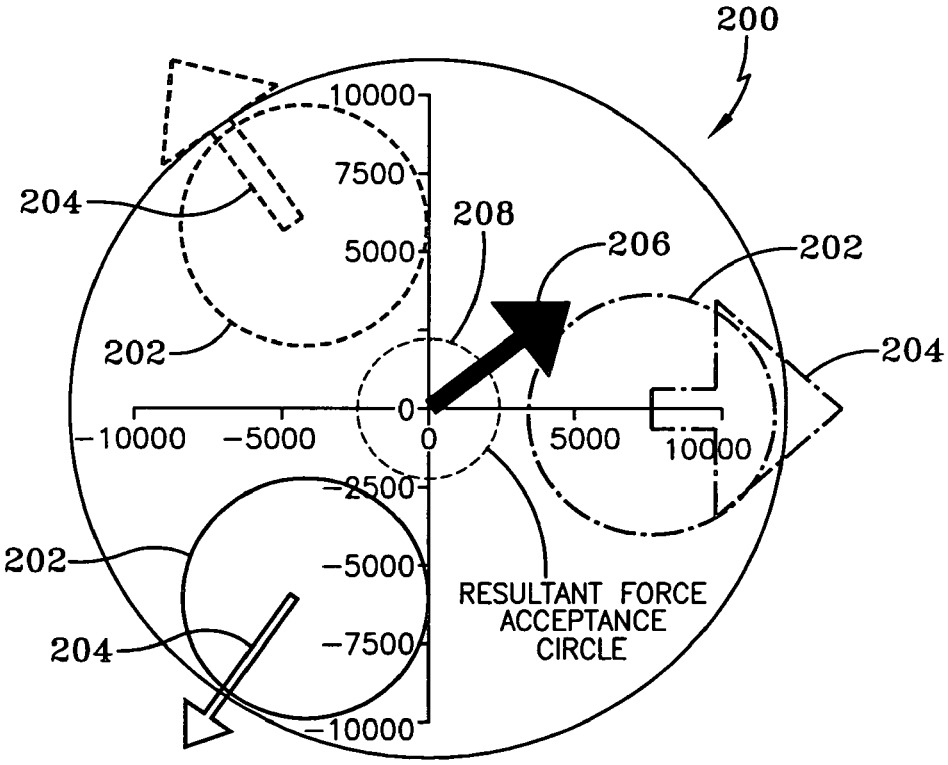
FIG. 10 is a resultant force diagram representative of forces exerted upon a revolving bowl by the grinding rolls.

Based upon the data collected and the subsequent analysis, various reporting formats for the system 120 have been developed. For example, as seen in FIG. 10, a resultant force diagram may be derived from the data collected. The resultant force represents the vector summation of the loads exerted by multiple roll assemblies on the bowl. As such, the force diagram includes a large circle 200—representing the bowl—and includes smaller circular representations 202 to represent the grinding elements within the bowl configuration. The radial force applied by each roll assembly is represented by the arrows 204 associated with each smaller circle grinding element 202. These roll forces can then be combined to generate a resultant bending force vector on the vertical shaft which is represented by an arrow 206 emanating from the center of the circle. In other words, all the calculated forces can be resolved into a composite resultant force and moment on the shaft. Any excessive cyclic stress occurring at the shaft speed is a result of uneven loading and as such, a sufficiently large composite resultant force can produce alternating stresses that will lead to fatigue failures of the main shaft. By reviewing this data and making various adjustments, these resultant forces can be minimized so as to extend the life of the shaft. A concentric scaled acceptance circle 208, which is centered within the large circle 200, is displayed to suggest acceptance criterion for the composite resultant force.

Figure 11A:
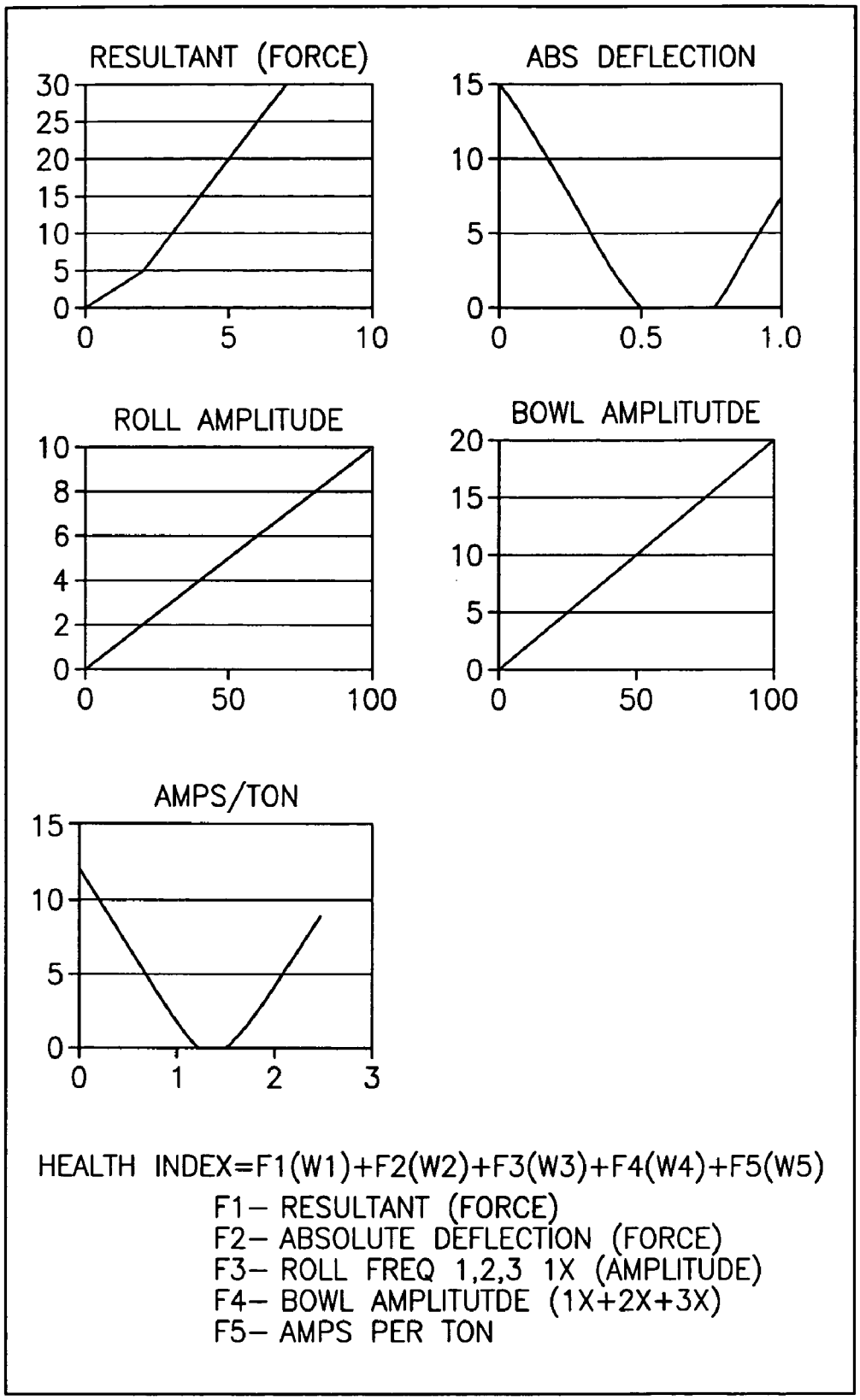
FIG. 11A illustrates the factors used in generating a health index and FIG. 11B is a bar graph that represents the health index of a group of pulverizers.
Figure 11B:
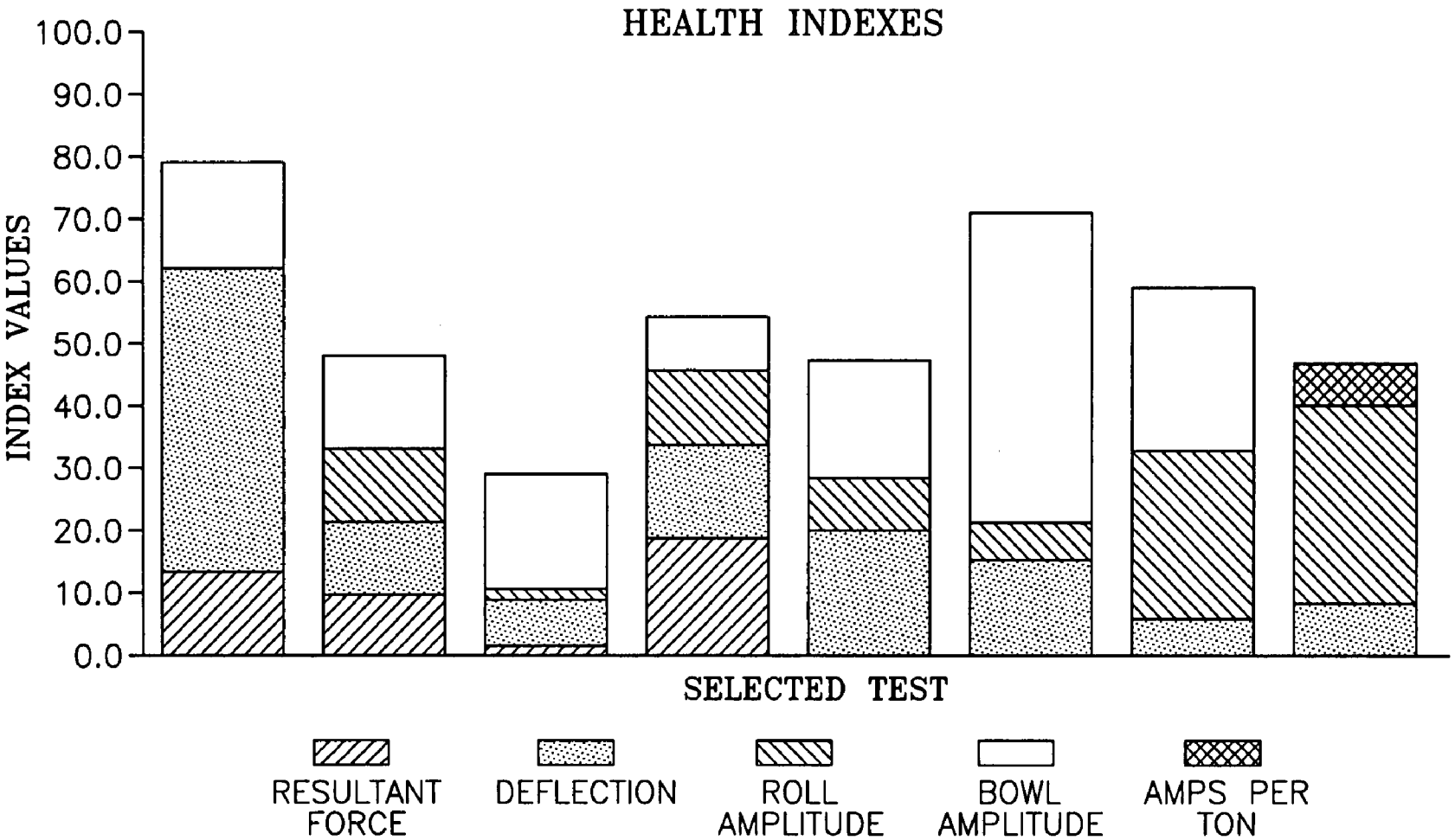

The resultant force value for each mill is but one factor incorporated into a health index as shown in FIG. 11. It can be seen that various other factors can be incorporated into a single health index, wherein a relatively higher health index value indicates that problems with that particular mill are more likely to occur. Although any one factor can be used as an index value to prompt remedial action, it is believed that multiple factors should be incorporated into the health index to provide a more accurate overall view of the health of the pulverizer unit. Parameters considered in the health index may include the composite resultant force value, a deflection value, a roll amplitude value, a bowl amplitude value and an amps per ton value. The deflection range is a representation of the empty mill to full load deflection with the deflection value being that corresponding to the specific load. If it is determined from the observed deflection values deviates from the expected value, this may provide an indication of spring breakage, excessive clearances or several other problems. The roll amplitude and bowl amplitude values are frequency specific, with related harmonics, for the particular component and which should be relatively low. Higher amplitude values can indicate defects in either the bowl or the roll thus indicating component wear. The amps per ton characteristic is a power consumption versus load comparison that should be in a linear relationship and similar for like mills grinding the same materials. In other words, as material is fed at a higher (lower) rate into the pulverizer, it will be expected that the motor will require more (less) current to be drawn so as to adequately pulverize the material. In the event observed data deviates from the norm, those data points which are not between the predetermined linear relationships may indicate operational problems. As shown in FIGS. 11A and 11B, the health index values may be represented as a bar graph so as to provide a visual indication as to the overall health of the specific pulverizer and, more precisely, the relative health of the pulverizers in the same production scenario. Each of the factors in the health index may be assigned a weight according to the users determination of a factor's relative importance. An exemplary weighting is shown in FIG. 11A.

Referring now to FIG. 12, it can be seen that an alarm screen might be provided to any web accessible workstation 136 or calculation engine 128. Various detection criteria attributable to the pulverizer are set by a system administrator wherein the administrator simply applies an engineered value in the table so as to set the parameters for that particular alarm detection criteria. The user, typically the operator, supervisory and/or maintenance personnel, can view the alarm status, the applicable criteria and background information by clicking the alarm of interest and wherein the system administrator can reset the alarm values as needed. Any alarm or pulverizer status condition can be further disseminated via the web server and/or by other communication such as pager, e-mail and or telephone through appropriate administrative entry and support software. In this manner, problems can be immediately recognized and undesirable trends recognized so as to allow for proper scheduling and maintenance of a pulverizer.

The advantages of the present invention are readily apparent. The system 120 provides the mill owner a self-monitoring system for detecting and trending a potential dynamic mill problem in real time. By utilizing the system 120, the end-user now has valuable information that can lead to improvements in areas of operations, performance and maintenance. In particular, extended life of grinding elements, shafts, bearings and drive trains through the balanced distribution of grinding element wear and minimized stress may be realized. The system allows for the reduction or timely exercise of preventive maintenance based upon real-time indications of material conditions and performance standards rather than operating hours or throughput. The trending and monitoring of suspect conditions or known problems allows for proactive, planned maintenance with optimal timing rather than the high cost of unscheduled reactive maintenance is enabled by use of the system 120. Moreover, enhanced process/production reliability, especially during critical demand periods can be maintained. As a result, more consistent product fineness for process efficiency and quality assurance can be maintained for overall plant performance. Use of the system also allows for improved compliance and margin with environmental regulations through optimized grinding processes and equipment conditions. Use of the system also allows for reduced unburnt combustible loss and slagging problems where appropriate. Yet further advantages are realized in reduced operations and maintenance costs with predictability and so as to allow for confidence in projected budgetary requirements. And, the system 120 allows for reduction in the inventory of spare parts with extended life and predictable maintenance requirements.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A pulverizer monitoring system comprising:

at least one pulverizer comprising a rotatable bowl assembly, at least one journal assembly having a deflectable grinding roll positioned proximal said rotatable bowl assembly, and a position sensor mounted to said at least one journal assembly to detect an amount of deflection of said grinding roll, said position sensor generating a position signal;

a data module associated with said at least one pulverizer, said data module receiving each position signal;

a calculation engine linked to said data module, said calculation engine analyzing said position signal and generating at least one characteristic report;

a workstation linked to said calculation engine to allow access to said at least one characteristic report; and a user interface linked to either said calculation engine or said workstation, said user interface enabling presetting of acceptable ranges of parameters and alarm levels for said at least one pulverizer when any one of said range of parameters is exceeded, said user interface displaying results of said at least one characteristic report.

2. The system according to claim 1, said pulverizer further comprising:

a shaft connected to said at least one rotatable bowl assembly, said calculation engine utilizing said position signal to determine a load exerted by said deflectable grinding roll upon said rotatable bowl assembly and said shaft, wherein said user interface displays a resultant force representation determined from the load applied to said rotatable bowl assembly and exerted by said grinding roll upon said shaft.

3. The system according to claim 2, wherein said resultant force display shows component forces exerted by said grinding roll upon said shaft.

4. The system according to claim 3, wherein said resultant force display shows a composite resultant force derived from each said component force associated with said shaft.

5. The system according to claim 4, wherein each said resultant force display is a polar representation, with each said component force represented by an arrow on a predetermined axis, and wherein said composite resultant force is represented by an arrow emanating from a center of said polar representation.

6. The system according to claim 2, further comprising:

a vibration sensor coupled to said shaft, said vibration sensor generating a vibration signal received by said data module for analysis by said calculation engine for use in generating said at least one characteristic report; and a motor coupled to said shaft, said motor generating an amps per ton signal received by said calculation engine.

7. The system according to claim 6, wherein one of said characteristic reports is selected from a group consisting of said resultant force, a deflection force, a roll amplitude, a bowl amplitude, and an amps per ton value.

8. The system according to claim 7, wherein said calculation engine generates a health index report that includes a representation of at least two of said characteristic reports.

9. The system according to claim 8, wherein said representations of said characteristic reports are associated with a predetermined weighting factor to provide an overall health index report for each said pulverizer.

10. The system according to claim 7, wherein said user interface is linked to one of said calculation engine and said workstation, said user interface enabling the setting of desired ranges for said characteristic reports.

11. The system according to claim 10, wherein said characteristic reports are highlighted when outside of said desired range.

12. The system according to claim 11, wherein said user interface enables generation of an alarm notice for distribution whenever said characteristic reports are outside said desired range.

* * * * *